United States Patent [19]

Heyman

[11] Patent Number: 4,614,460

[45] Date of Patent: Sep. 30, 1986

[54] SUPPORT STRUCTURE

[76] Inventor: Klas Heyman, Ängemarken 8 B, Gothenburg, Sweden

[21] Appl. No.: 642,701

[22] Filed: Aug. 21, 1984

Related U.S. Application Data

[63] Continuation of Ser. No. 394,799, Jul. 2, 1982, abandoned.

[51] Int. Cl.[4] ..... E02B 17/08; E02D 29/00

[52] U.S. Cl. ..... 405/195; 405/229

[58] Field of Search ..... 405/195, 196, 203–208, 405/211, 222, 223, 229

[56] References Cited

U.S. PATENT DOCUMENTS

| | | | |
|---|---|---|---|
| 868,092 | 10/1907 | Hennebique | 405/205 |
| 2,892,314 | 6/1959 | Hornsby et al. | 405/196 |
| 2,939,290 | 6/1960 | Crake | 405/205 |
| 3,054,268 | 9/1962 | Muller | 405/207 |
| 3,792,538 | 2/1974 | De Groot | 405/196 X |
| 3,861,157 | 1/1975 | Hillen | 405/223 |
| 3,928,982 | 12/1975 | Lacroix | 405/224 |
| 4,199,279 | 4/1980 | Himeji et al. | 405/223 X |
| 4,270,877 | 6/1981 | Post | 405/196 X |

FOREIGN PATENT DOCUMENTS

| | | | |
|---|---|---|---|
| 236437 | 11/1961 | Australia | 405/195 |
| 876547 | 9/1961 | United Kingdom | 405/195 |

*Primary Examiner*—Dennis L. Taylor
*Assistant Examiner*—Nancy J. Stodola
*Attorney, Agent, or Firm*—Holman & Stern

[57] ABSTRACT

A support structure, especially for under-water work, comprises a hollow pillar, which downwardly merges into a reversed funnel structure, having a base area selected with respect to the expected load and to local ground conditions and macadam, or other material with internal friction, filling the funnel structure and at least part of the pillar, the base angle of the funnel structure being slightly greater than the natural angle of repose of the fraction of friction material used. After a possible vibration of the macadam the funnel structure will be completely filled, whereby the load on the pillar will be transferred to the cone of macadam and be distributed over the bottom surface, below the funnel structure, which may along its lower edge be provided with a dented skirt suited to enter into a soft bottom surface.

7 Claims, 8 Drawing Figures

FIG. 1
PRIOR ART
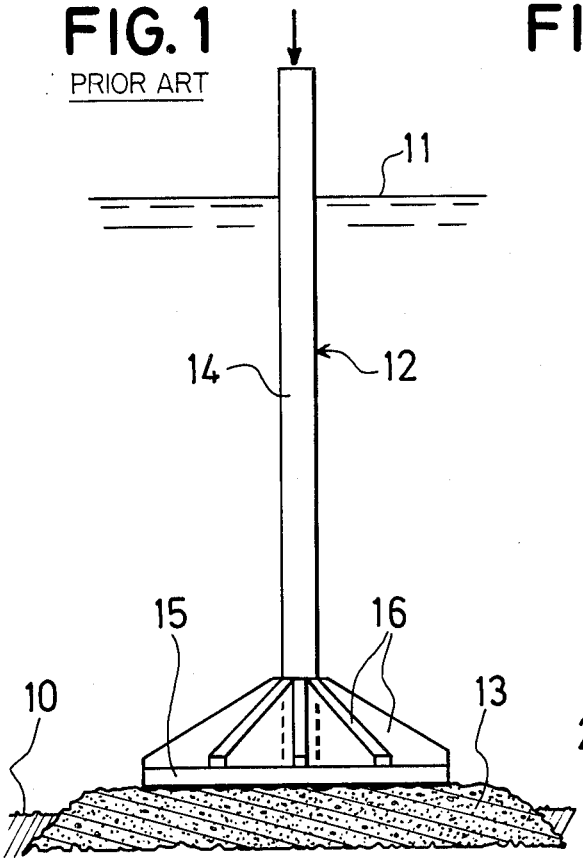
FIG. 3
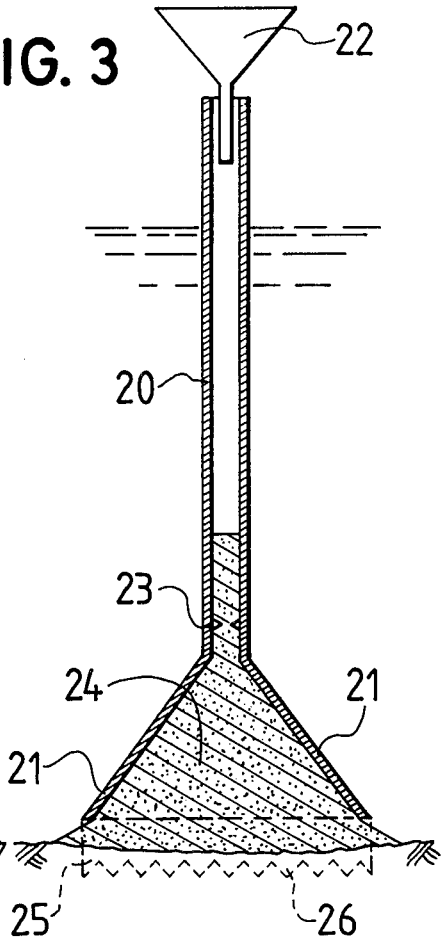
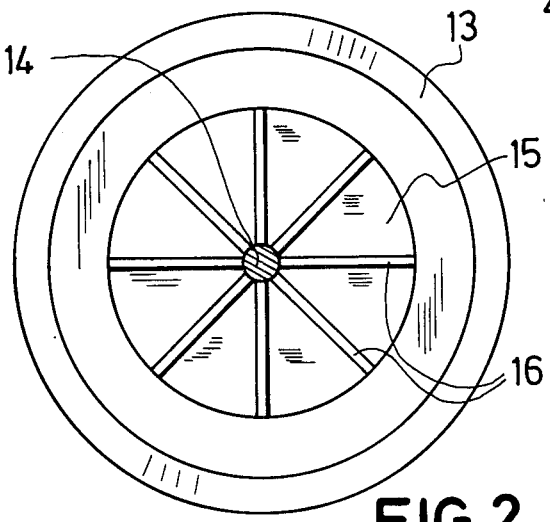
FIG. 2
PRIOR ART
FIG. 4
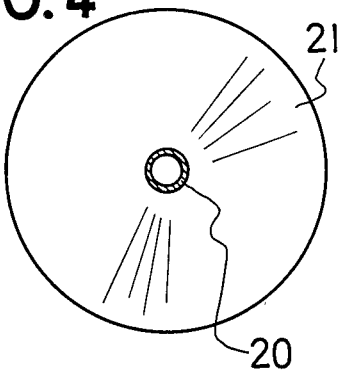

SUPPORT STRUCTURE

This is a continuation of application Ser. No. 394,799, filed July 2, 1982 which is abandoned.

BACKGROUND OF THE INVENTION

1. Field Of The Invention

This invention relates to a support structure for under water and to a method for making such a support structure.

Foundation works in under-water constructions are usually complicated and expensive. When a support structure is to be placed upon the bottom of a harbor, river, at sea, or in a watercourse, where piledriving is not required, a bed of gravel or crushed material (macadam) is usually laid upon the bottom. This bed must be carefully levelled, so it becomes even and horizontal. This is difficult work in view of the depth of the water, which may be considerable, and the reduced sight at such depth.

Gravels and crushed stones have different angles of repose, depending upon the size and the shape of the particles (the fraction), as well as the nature of the rock material. If a mound of macadam is subjected to a modest, evenly applied load, say 5 tons/square meter, the natural slope, determined by the angle of repose (the angle of maximum slope at which a heap of loose solid material will stand without sliding) will remain unchanged under the load. The macadam only becomes slightly compressed. If macadam is distributed through a tube upon a horizontal substratum a conical mound is obtained, which covers a circular base area, and has a sloping envelope surface with an even contour. This is true, even if the bottom is un-even or slightly inclined.

The object of the present invention is to simplify the forming of such mounds of friction material in exactly desired positions, and to utilize the same as foundations for support structures.

SUMMARY OF THE INVENTION

The invention is concerned with a support structure erectable upon a bed of friction material, for instance macadam, and is especially suited for use where it is, at least partly, submerged below a body of water.

A method for erecting such a support structure is characterized in forming a rigid, hollow pillar and attaching to one end thereof a reversed, likewise rigid funnel-shaped structure, locating said pillar substantially vertically with the base of said funnel-shaped structure about level with the bottom below said body of water, and filling a friction material into said funnel-shaped structure and up in the pillar by way of said hollow pillar, the base angle of said reversed funnel-shaped structure exceeding the angle of repose of the friction material.

A support structure according to the invention is characterized in a rigid, hollow pillar, which at its lower end merges into a reversed, likewise rigid, funnel-shaped structure having a base area noticeably larger than the cross-sectional area of the pillar, and at which the base angle exceeds the angle of repose of friction material used.

The internal surface of the funnel-shaped structure will thus be extensively supported by the cone of macadam, which transfers the load from the support structure to the bottom.

In order to ensure an exact formation of the cone of macadam the tubular pillar may be provided with a restriction providing a centrally located passage adjacent to the transition between the pillar and the pillar structure. Furthermore the funnel structure at its base may be provided with a skirt, possibly having a dented lower edge which sinks into the bottom mud and prevents undesired spreading of macadam outside of the funnel structure. Such a skirt is furthermore important when there is a risk of erosion. The support structure, furthermore, is provided with means for maintaining the position of the pillar during erection.

The pillar must not necessarily have a circular cross-section, but may have a square or otherwise formed cross-section. The funnel structure may likewise have a shape differing from the circular, for instance being polygonal.

The support structure is well suited to be used for the erection of quays or piers, as well as for working platforms and ramps, etc. It may also for example be used with certain bridge structures and with offshore plants.

BRIEF DESCRIPTION OF THE DRAWINGS

FIG. 1 is a schematic elevational view showing a support structure of conventional type, used for under-water constructions, FIG. 2 is a plan view of the foot of a support structure according to FIG. 1, FIG. 3 is a cross-sectional view of a support structure according to the invention during erection, FIG. 4 is a plan view of the foot of a support structure according to FIG. 3, and FIGS. 5–8 are schematic views showing consecutive steps during the erection of a pier or a quay-platform, using support structures according to the invention.

DESCRIPTION OF A PREFERRED EMBODIMENT

Figure 5:
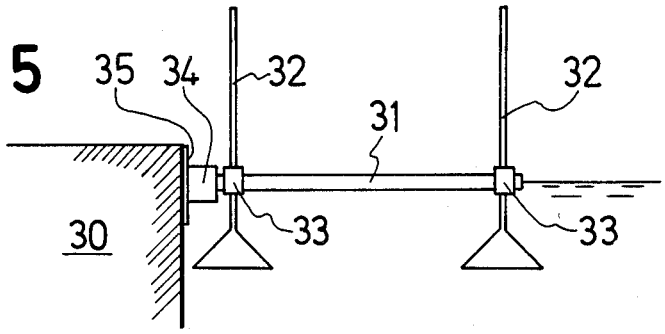

In FIGS. 1 and 2 numeral 10 dentoes the bottom below a body of water, and 11 denotes the water surface. A support structure 12 of conventional type, as shown in FIG. 1, presupposes that a level and fully horizontal substratum 13 of gravel or macadam is formed upon the bottom. The shape of the support structure may vary depending upon the depth of the wter, and upon the expected load, but it consists essentially of a pillar 14 and a foot-plate 15, usually provided with reinforcing ribs 16.

The macadam may be tipped out from a barge, or the like, and an uneven mound, or group of mounds is formed which must be levelled out by means of a scraper being dragged forwards and backwards over the location. Due to the difficulty in locating the substratum exactly in relation to the desired position of the support structure it is often necessary to cover an area, which is considerably bigger than the foot-plate, and in order to compensate possible irregularities in the bottom profile and possible inclination a surplus of macadam must be used. The difficulties in forming the substratum, and a possible final control by a diver results in an expensive foundation.

A support structure according to the invention, partly filled with macadam, is shown in FIG. 3 and comprises a tubular pillar 20 attached to an inverted funnel structure 21, the base area of which is dimensioned with respect to the conditions of the bottom and the expected load upon the pillar. The macadam is filled by way of the pillar, and the funnel structure, directly onto the bottom.

When the pillar with its funnel structure has been brought to the desired position, macadam is filled by means of a supply device 22 in an amount to ensure that the material rises partly up into the pillar. This will compensate possible future settlements. The macadam may be subjected to vibrations, so that it becomes well compacted and forms a homogenous mound (cone). This is well centered and concentrated directly below the pillar, without unnecessary spreading outside the desired area.

If a fraction of macadam is selected, which in water has an angle of repose of, say 45°, the supporting structure is selected with a base angle being somewhat bigger than the angle of repose of macadam, say 48°. The base area of the funnel structure is dimensioned with respect to the permissible specific bottom load. When the macadam is filled into the funnel structure by way of the pillar, the funnel structure will be 100% filled, and the internal envelope face of the funnel structure will rest directly upon the cone of macadam. The funnel structure will in this manner be fully supported inside and may be designed as a simple shell structure. The load upon the pillar will thus, by way of the funnel structure and the macadam, be transferred to the bottom surface below the macadam cone.

As the angle of repose of the cone is less than the base angle of the funnel structure, it is evident that the macadam will adapt itself to the internal surface of the funnel and to the bottom profile, and to 100% will fill the space between the funnel structure and the bottom.

The support structure may advantageously be positioned so the base line of the funnel structure remains slightly above the bottom floor. Possible projections at the bottom, such as stones or wreckage, will then not carry some part of the funnel margin, which could lead to local strains. A certain amount of macadam will be spread outside the funnel, but the structure will nevertheless be completely filled. When the bottom is soft and muddy, or when there is a risk of erosion, it may be advantageous to provide the funnel structure 21 with a projecting skirt 25 along its lower edge. The skirt is directed vertically and is preferably provided with a dented edge 26, which easily sinks down into the soft bottom. The skirt will aid in preventing the macadam from spreading out.

When high loads, or a risk of buckling is at hand, the pillar may have a considerable diameter. In order to locate the cone of macadam centrally in the funnel structure, a restriction 23 may be provided within the pillar, just above the transition thereof into the funnel structure 21.

With under-water constructions the hollow pillar should preferably project above the level of the water, i.e. to facilitate the filling of macadam.

The pillar need not be a circular tube, but can have square or some other suitable cross-section. The pillar can furthermore be flared, i.e. have a downwardly increasing cross-section.

On certain occasions, i.e. to save macadam, it may be desirable to fit inserts within the funnel structure, which makes it possible to distribute the macadam mainly along the periphery of the funnel structure. It may also be possible to distribute the macadam in a number of smaller cones arranged around the center line.

When the funnel structure and the pillar have been filled and the macadam has settled, the shell may be injected with some suitable grout.

Figure 6:
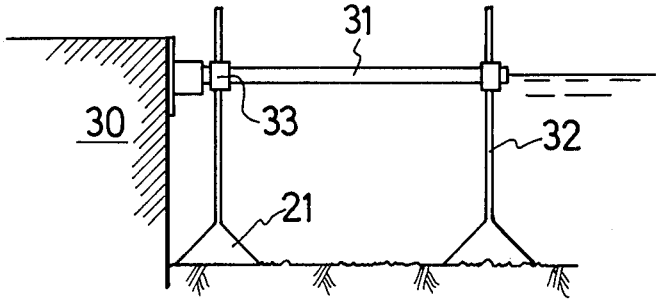
Figure 7:
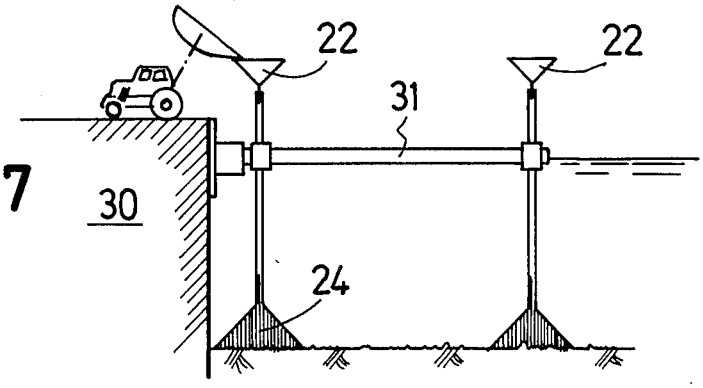
Figure 8:
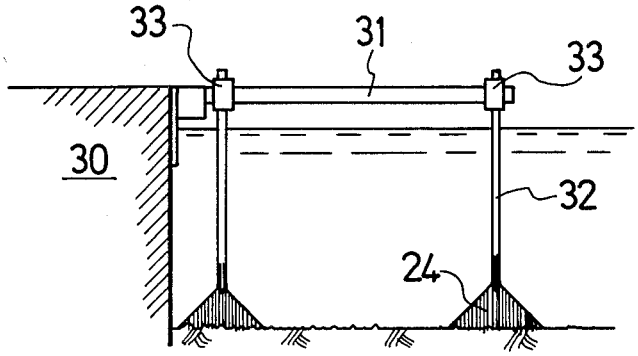

Support structures of this type may advantageously be used for instance with temporary or permanent quays, piers, ramps, or working platforms, etc., which are carried by a number of "legs". FIGS. 5–7 show the invention as used with a temporarily erectable pier or ramp adjacent to a quay 30. The pier includes a floating pontoon 31, which in owrking position will be carried by means of a number of support structures 32, or legs, of the type shown in FIG. 3. The legs are mounted in the pontoon 31 in any suitable manner so that they may be raised or lowered, for instance by means of jack-up mechanisms 33.

The pontoon 31 is provided with mooring devices 34, which in this embodiment will slide along fenders 35 at the quay 30, and which will retain the pontoon at a distance from the latter. The pontoon 31 is towed, with the legs 32 raised, to the selected location, and is carefully moored at the quay, The positions of the legs will in this manner be exactly defined—see FIG. 5. Thereupon the legs are lowered, possibly by means of jack-up mechanisms, so the funnel structure 21 will rest upon the bottom, or next to the bottom of the harbor, with possible skirts 25 sinking into the bottom—FIG. 3. Movements of the waves and possible tide water will not act upon the lowered legs, as the floating pontoon still may move freely up and down along the pillars, when the jack-up mechanisms have been disengaged. Macadam is then filled into the pillars from the quay, or from a barge, as the pontoon should not be subjected to any load while it is still floating—FIG. 7.

When the cones 24 of macadam below the funnel structures have been vibrated and have had time to settle, the pontoon 31 is successively raised out of the water by means of the jack-up mechanisms 33 to a desired level in relation to the quay 30 to a horizontal, or inclined position. A communication ramp is then extended from the quay onto the pontoon, so vehicles may travel across the pier. The jack-up mechanisms permit an easy readjustment of th position, whenever needed. The pontoon 31 is designed in such a manner that the highest water level will just reach its bottom plating. There are, of course, other possibilities of adjusting the height position in relation to the harbor bottom and to the occasional water level, for example by trimming with ballast water.

If it becomes necessary to move the pontoon 31 to some other place, the pontoon is lowered until it floats, whereupon the legs 32 are lifted to the position shown in FIG. 5. This is easily accomplished by means of the jack-up mechanisms, as the legs are not fixed to the bottom.

The remaining mounds of macadam may easily be removed by means of dredging, if they are considered as a hinderance to future traffic at the quay.

The invention may of course also be used with working platforms or the like, which are located separate from a quay, and which during the erection are anchored in any suitable manner for exact positioning of the supporting legs. One field of use of such platforms is within the off-shore industry.

The invention may also advantageously be used for constructions erected upon a bed of friction material above ground level. The principle is exactly the same. As an example may be mentioned constructional works in water-soaked grounds, bogs and the like, where support structures are located in a well or trench and are then filled with macadam. Such works as sheet-piling, draining of water and casting of concrete, etc. can then be avoided.

What I claim is:

1. A structure for transferring a vertical load to a supporting surface in a body of water wherein the supporting surface has a known load-carrying capacity comprising, a single hollow conically-shaped member of rigid material having a base adapted to be set substantially level on the supporting surface and a smaller open upper end, a single hollow rigid pillar in the shape of a circular cylinder attached at one end to said upper end of said conically-shaped member and extending substantially vertically therefrom and having a substantially uniform cross-sectional area throughout its length and an open upper end, the cross-sectional area of said base being several times larger than the cross-sectional area of said pillar, and a continuous mass of friction material filling said conically-shaped member to form a support therein having an outer surface shaped to conform to the inner surface of said conically-shaped member, and at least partly filling said pillar, said conically-shaped member, pillar and friction material forming a single unitary individual and independent support, the base angle of said conically-shaped member being slightly larger than the angle of repose of the friction material and being of such a value that the conically-shaped member is completely filled and the interior surface thereof is entirely supported on said friction material and the vertical forces on the support structure are entirely supported by the friction material and are distributed vertically and substantially evenly over the area of the supporting surface beneath the base, and the weight of the support structure per unit area of the supporting surface covered by the base is minimized.

2. The support structure according to calim 1, wherein the section where said pillar is attached to said conically-shaped member forms a transition, and said hollow pillar adjacent to the transition is provided with a reduced diameter restriction having a centrally located passage therethrough for passage of said friction material to center the conical mass thereof within said funnel-shaped member.

3. The support structure according to claim 2, wherein said conically-shaped member at its lower edge is provided with a skirt extending downwardly substantially in the axial direction of said pillar.

4. The support structure according to claim 3, wherein the lower edge of said skirt is dented.

5. The support structure as claimed in claim 1 wherein said friction material is macadam.

6. The support structure as claimed in claim 2 wherein said friction material is macadam.

7. The support structure as claimed in claim 1 and further comprising a floating pontoon, and means to movably support a plurality of said support structures on said pontoon to facilitate varying the height of said pontoon.

* * * * *